US008844408B2

(12) United States Patent
Chen

(10) Patent No.: US 8,844,408 B2
(45) Date of Patent: Sep. 30, 2014

(54) PNEUMATIC RATCHET WRENCH WITH A PNEUMATICALLY ACTUATED REVERSING DEVICE

(75) Inventor: Chin-Chi Chen, Taichung (TW)

(73) Assignee: Basso Industry Corp., Taichung (TW)

( * ) Notice: Subject to any disclaimer, the term of this patent is extended or adjusted under 35 U.S.C. 154(b) by 395 days.

(21) Appl. No.: 13/420,332

(22) Filed: Mar. 14, 2012

(65) Prior Publication Data

US 2012/0234139 A1 Sep. 20, 2012

(30) Foreign Application Priority Data

Mar. 14, 2011 (TW) ..... 100108541 A

(51) Int. Cl.
*B25B 21/00* (2006.01)

(52) U.S. Cl.
CPC ..... *B25B 21/004* (2013.01)
USPC ..... 81/57.13; 81/57.39; 81/63

(58) Field of Classification Search
USPC ..... 81/57.13, 57.14, 57.19, 57.29, 57.31, 81/57.39, 57.44, 63, 63.1, 63.2
See application file for complete search history.

(56) References Cited

U.S. PATENT DOCUMENTS

| | | | | |
|---|---|---|---|---|
| 6,640,669 | B2 * | 11/2003 | Izumisawa | 81/57.39 |
| 8,051,746 | B2 * | 11/2011 | Bouchard et al. | 81/57.39 |
| 2008/0083303 | A1 * | 4/2008 | Baker | 81/57.39 |
| 2008/0142329 | A1 * | 6/2008 | Kobayashi | 192/43 |

* cited by examiner

*Primary Examiner* — Robert Scruggs
(74) *Attorney, Agent, or Firm* — Brinks Gilson & Lione

(57) ABSTRACT

A pneumatic ratchet wrench having a pneumatically actuated reversing device includes two cylinders disposed downstream of two branch conduits, and two plungers, each slidable in the respective cylinder by a burst of pressurized air from the branch conduits to bring an actuator into engagement with a direction selector so as to turn the direction selector in a selected one of clockwise and counterclockwise directions for unidirectionally rotating a drive body. The operation of direction selection is easy and handy to conduct.

9 Claims, 10 Drawing Sheets

PNEUMATIC RATCHET WRENCH WITH A PNEUMATICALLY ACTUATED REVERSING DEVICE

CROSS-REFERENCE TO RELATED APPLICATION

This application claims priority of Taiwanese Patent Application No. 100108541, filed on Mar. 14, 2011, the disclosure of which is herein incorporated by reference.

BACKGROUND OF THE INVENTION

1. Field of the Invention

This invention relates to a ratchet wrench, more particularly to a pneumatic ratchet wrench with a pneumatically actuated reversing device for selectively driving a drive body in a clockwise or counterclockwise direction.

2. Description of the Related Art

Referring to FIG. 1, a conventional pneumatic ratchet wrench 1 such as that disclosed in U.S. Pat. No. 6,640,669B2 generally includes a ratchet housing 11 and a drive spindle 12 which is disposed transverse to the ratchet housing 11 and which is unidirectionally rotated by means of a ratchet unit 17 for fastening or loosening a fastener engaged therewith through transmission and conversion of the rotation of an output shaft of an air motor (not shown). A direction reversing device includes a gear 13 which is rotatably mounted on the ratchet housing 11, and two arms 14 which are respectively attached to two buttons 15 to be moved alternately to engage the gear 13 in response to operation of the respective buttons 15, thereby permitting rotation of the gear 13 in a corresponding direction. The arms 14 are connected respectively by springs 16 to the ratchet housing 11 to bias the respective arms 14 away from the gear 13.

Since it is needed to apply a manual force to operate the selected button 15 during the fastening or loosening operation, and since the manual force applied is in a direction parallel to the direction of movement of the selected arm 14, the manual force has to counter the biasing action of the corresponding spring 16 and overcome the frictional resistance generated as a result of engagement between the corresponding arm 14 and the gear 13. Thus, the fastening or loosening operation is laborious and inconvenient to conduct.

SUMMARY OF THE INVENTION

An object of the present invention is to provide a pneumatic ratchet wrench which can be operated effortlessly and conveniently.

According to this invention, the pneumatic ratchet wrench includes a ratchet head unit, an elongated shell, left and right branch conduits, and left and right valve units. The ratchet head unit includes a head mounting frame which extends in a longitudinal direction, and which has selector-side and drive-side walls opposite to each other in a first transverse direction that is transverse to the longitudinal direction, a swingable ratchet member which is mounted on the drive-side wall, and which is adapted to be driven by a pneumatic drive unit to make a swinging movement, a drive body which is coupled with the swingable ratchet member to be unidirectional rotatable therewith, and which has a drive-side segment that extends in the first transverse direction for tightening or loosening a fastener, a pawl which has two pawl regions configured such that, in response to a selected one of clockwise and counterclockwise forces, a corresponding one of the first and second pawl regions is brought into pawl engagement with the swingable ratchet member so as to permit the drive body to be unidirectionally rotated with the swinging movement of the swingable ratchet member, and a direction selector which is rotatably mounted on the selector-side wall, and which has a toothed rim segment and an actuating segment that is disposed to exert the selected one of the clockwise and counterclockwise forces on the pawl. The ratchet head unit further includes: left and right cylinders which are disposed on the selector-side wall and spaced apart from each other in a second transverse direction that is transverse to the first transverse direction and the longitudinal direction and each of which has an inlet port; left and right plungers, each of which is fitted in and slidable relative to a respective one of the left and right cylinders to move between a non-pressurized position, where pressurized air is cut off from the inlet port, and a pressurized position, where a burst of the pressurized air is permitted to pass through the inlet port; and left and right actuators which are respectively disposed forwardly of the left and right cylinders, and which are respectively connected to the left and right plungers. Each of the left and right actuators has a rack region which is moved along a linear path that is tangential to a respective one of two diametrically opposed areas of the toothed rim segment when a respective one of the left and right plungers is moved from the non-pressurized position to the pressurized position. The elongated shell is coupled with and disposed rearward from the head mounting frame, and has a main inlet port adapted to be in fluid communication with a source of pressurized air, and a main conduit disposed downstream of the main inlet port. The left branch conduit is disposed downstream of the main conduit and upstream of the inlet port of the left cylinder. The right branch conduit is disposed downstream of the main conduit and upstream of the inlet port of the right cylinder. The left and right valve units are disposed to control passage of the pressurized air in the left and right branch conduits, respectively.

By means of the arrangement of the conduits, the cylinders, and the plungers serving as a pneumatically actuated reversing device, the direction selection is easy and handy to perform.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
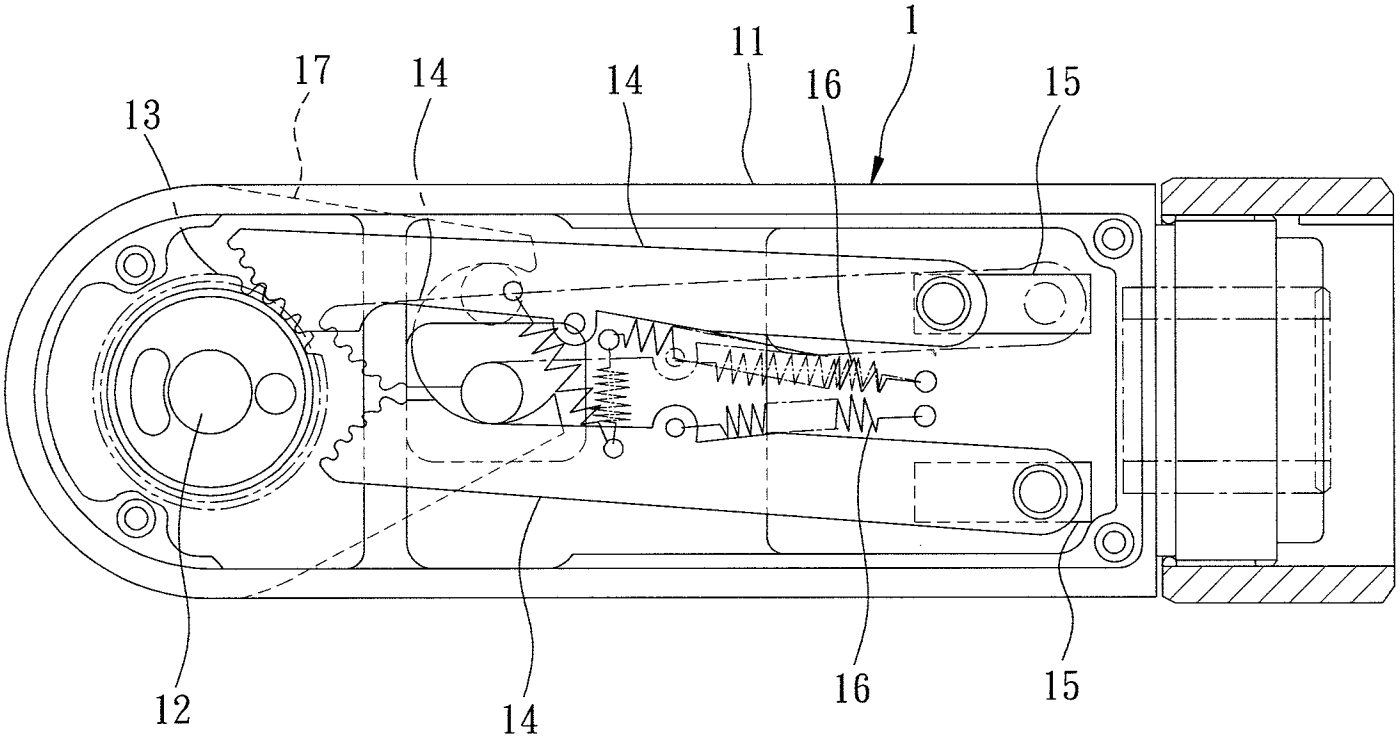
FIG. 1 PRIOR ART
FIG. 1 is a plan view of an internal mechanism of a conventional pneumatic ratchet wrench disclosed in U.S. Pat. No. 6,640,669 B2.

Before the present invention is described in greater detail, it should be noted that same reference numerals have been used to denote like elements throughout the specification.

Figure 2:
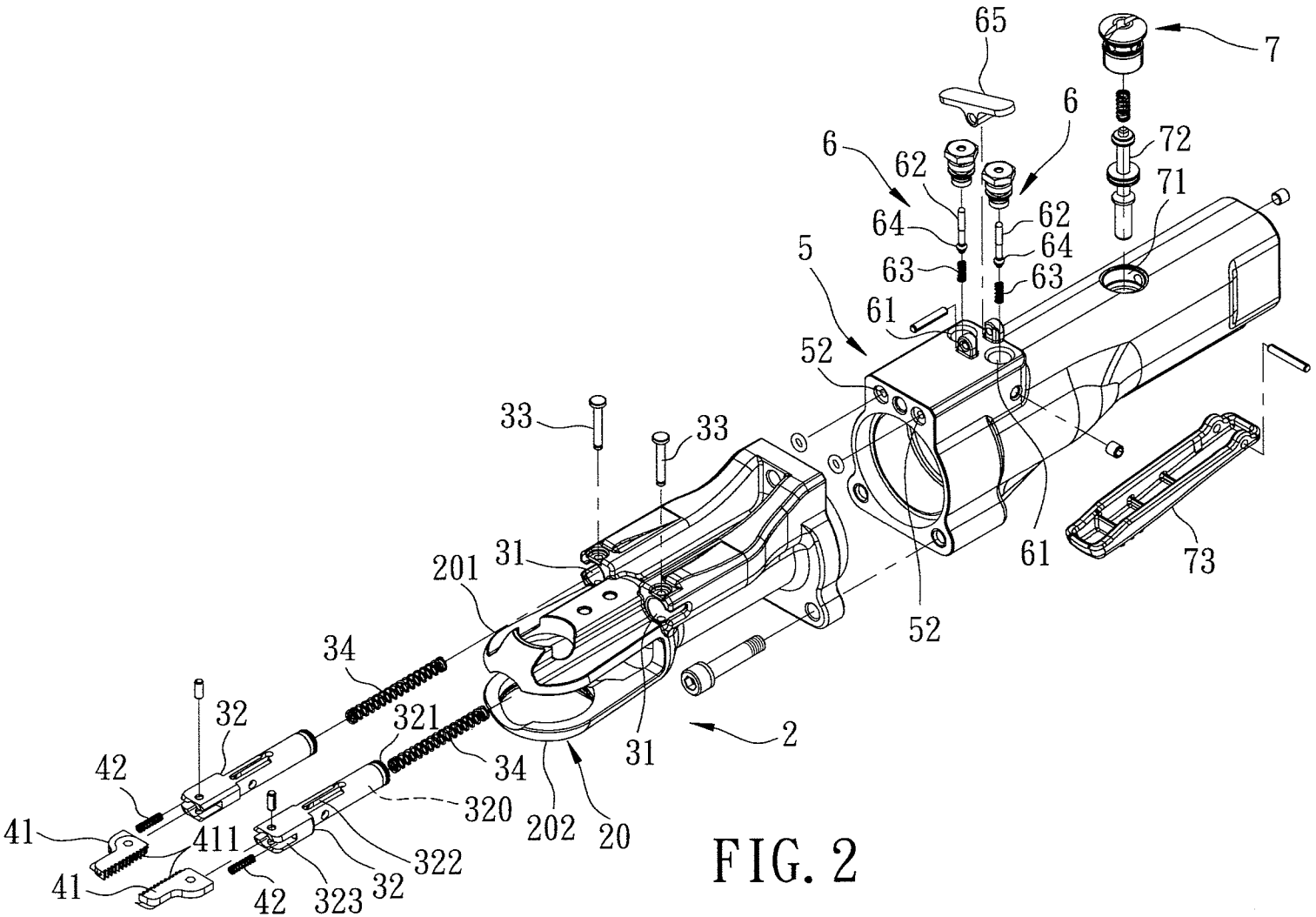
FIG. 2 is an exploded perspective view of the first embodiment of a pneumatic ratchet wrench according to this invention.

Referring to FIG. 2, the first embodiment of a pneumatic ratchet wrench according to the present invention is shown to comprise a ratchet head unit 2, an elongated shell 5, left and right branch conduits 52, and left and right valve units 6.

Figure 5:
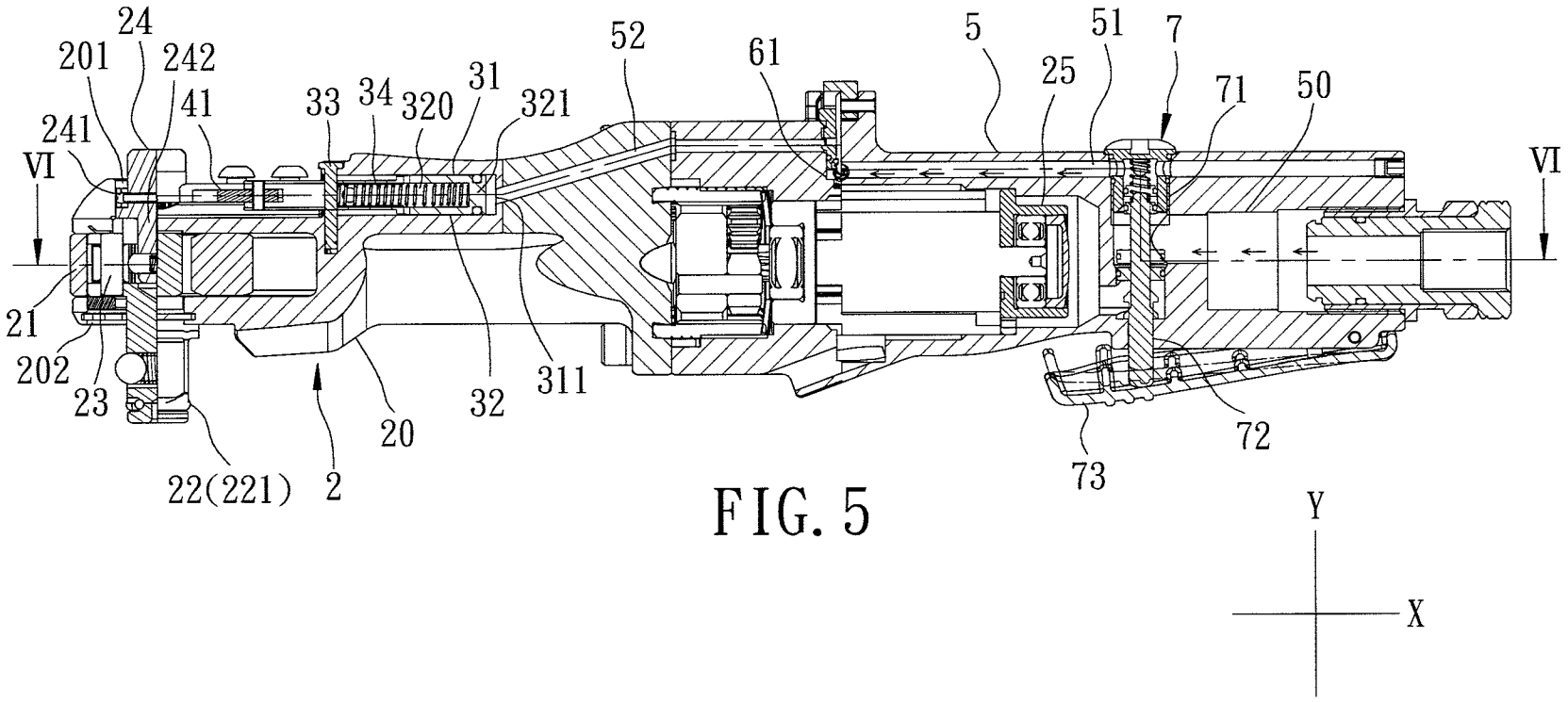
FIG. 5 is a sectional view taken along line V-V of FIG. 3.

With reference to FIG. 5, the ratchet head unit 2 includes a head mounting frame 20 which extends in a longitudinal direction (X), and which has selector-side and drive-side walls 201, 202 opposite to each other in a first transverse direction (Y) that is transverse to the longitudinal direction (X), a swingable ratchet member 21 which is mounted on the drive-side wall 202, and which is adapted to be driven by a pneumatic drive unit 25 in a known manner to make a swinging movement about a rotating axis that is oriented in the first transverse direction (Y), a drive body 22 which is coupled with the swingable ratchet member 21 to be unidirectional rotatable therewith, and which has a drive-side segment 221 that extends in the first transverse direction (Y) for tightening or loosening a fastener attached thereto, a pawl 23 which has two pawl regions configured such that, in response to a selected one of clockwise and counterclockwise forces, a corresponding one of the first and second pawl regions is brought into pawl engagement with the swingable ratchet member 21 so as to permit the drive body 22 to be unidirectionally rotated with the swinging movement of the swingable ratchet member 21, and a direction selector 24 which is rotatably mounted on the selector-side wall 201, and which has a toothed rim segment 241 and an actuating segment 242 that is disposed to exert the selected one of the clockwise and counterclockwise forces on the pawl 23 when the toothed rim segment 241 is turned in a selected one of clockwise and counterclockwise directions.

Figure 3:
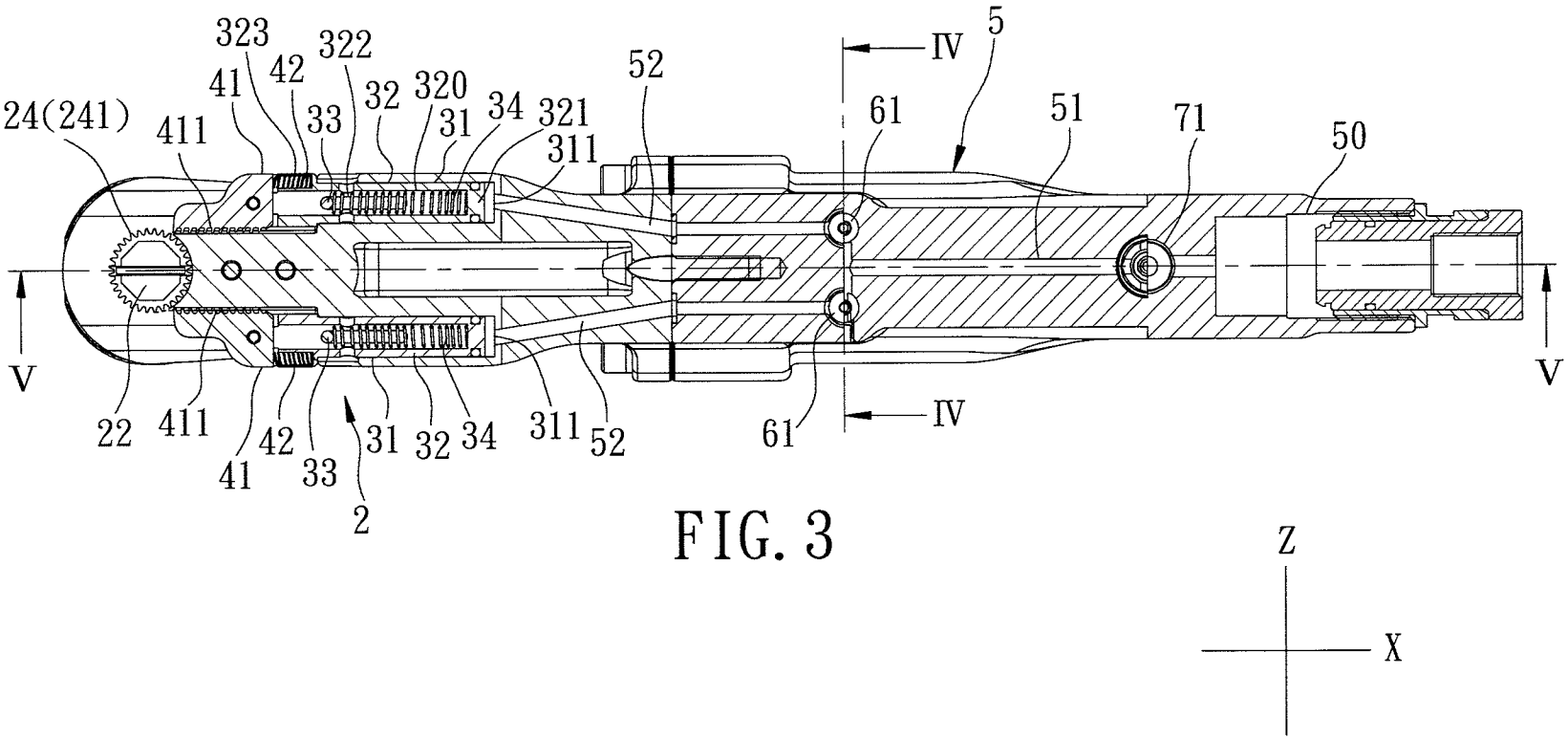
FIG. 3 is a sectional view of the first embodiment.

As shown in FIGS. 2, 3 and 5, left and right cylinders 31 are disposed on the selector-side wall 201 of the head mounting frame 20 and are spaced apart from each other in a second transverse direction (Z) that is transverse to the first transverse direction (Y) and the longitudinal direction (X). Each of the left and right cylinders 31 extends in the longitudinal direction (X) and has an inlet port 311. Left and right plungers 32 are fitted in and slidable relative to the left and right cylinders 31, respectively. Each of the left and right plungers 32 is forced by a burst of pressurized air from the inlet port 311 to move from a non-pressurized position, where the pressurized air is cut off from the inlet port 311, and a pressurized position, where the burst of the pressurized air is permitted to pass through the inlet port 311. Each of the left and right plungers 32 has a tubular chamber 320 which terminates at a rear closed end 321, a slot 322 which extends in the longitudinal direction (X) to terminate at front and rear limits, and which communicates with the tubular chamber 320, and an insert hole 323 which is formed at a front end thereof. The head mounting frame 20 has two pin posts 33, each of which extends radially into the tubular chamber 320 and is fitted in the respective slot 322 so as to abut against the front or rear limit, thereby preventing the respective plunger 32 from moving beyond the non-pressurized or pressurized position. Two first biasing members 34 are disposed in the tubular chambers 320, respectively. Each of the first biasing members 34 is disposed to abut against the respective pin post 33 and the rear closed end 321 so as to bias the respective plunger 32 toward the non-pressurized position.

Figure 8:
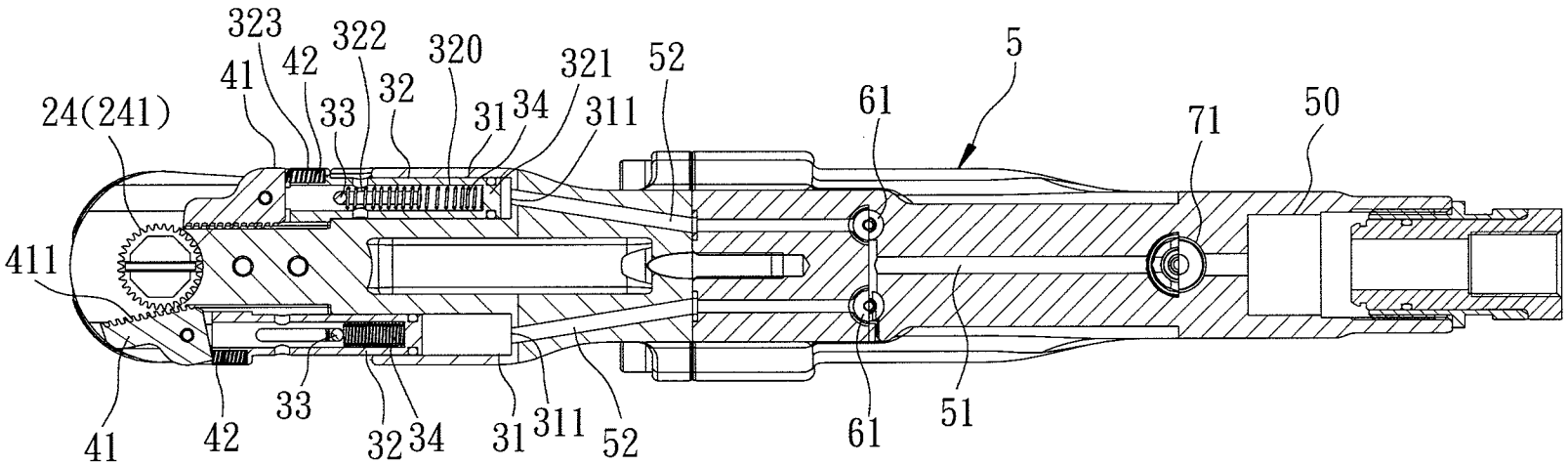
FIG. 8 is a sectional view showing an actuator moved back toward a non-pressurized position.

Left and right actuators 41 are respectively disposed forwardly of the left and right cylinders 31. Each of the left and right actuators 41 is pivotally connected in the insert hole 323 of the respective plunger 32 about a pivot axis that is parallel to the rotating axis of the swingable ratchet member 21. Each of the left and right actuators 41 has a rack region 411 which is moved along a linear path that is tangential to a respective one of two diametrically opposed areas of the toothed rim segment 241 of the direction selector 24 when the respective plunger 32 is moved from the non-pressurized position to the pressurized position. By pivoting of the actuators 41 to the plungers 32, when the respective plunger 32 is moved toward the non-pressurized position, as shown in FIG. 8, the rack region 411 of the corresponding actuator 41 is permitted to turn away from the toothed rim segment 241 of the direction selector 24 so as to facilitate backward movement of the plunger 32. A second biasing member 42 is disposed in the insert hole 323 and between the respective plunger 32 and an opposite region of the respective actuator 41 relative to the rack region 411 in terms of the pivot axis so as to bias the rack region 411 toward the toothed rim segment 241, thereby stabilizing the movement of the respective actuator 41 along the linear path when the plunger 32 is moved to the pressurized position.

The elongated shell 5 is coupled with and disposed rearward from the head mounting frame 20, and has a main inlet port 50 adapted to be in fluid communication with a source of the pressurized air, and a main conduit 51 disposed downstream of the main inlet port 50. As shown in FIGS. 2 and 5, a main valve unit 7 includes a main valve seat 71 which is disposed in the elongated shell 5 and which preferably extends through the elongated shell 5 in the first transverse direction (Y) to communicate with the main conduit 51, and a spring-biased main valve rod-and-disc 72 which is movable in the first transverse direction (Y) relative to the main valve seat 71 and which is operated by pressing a lever 73 to control passage of the pressurized air.

Figure 4:
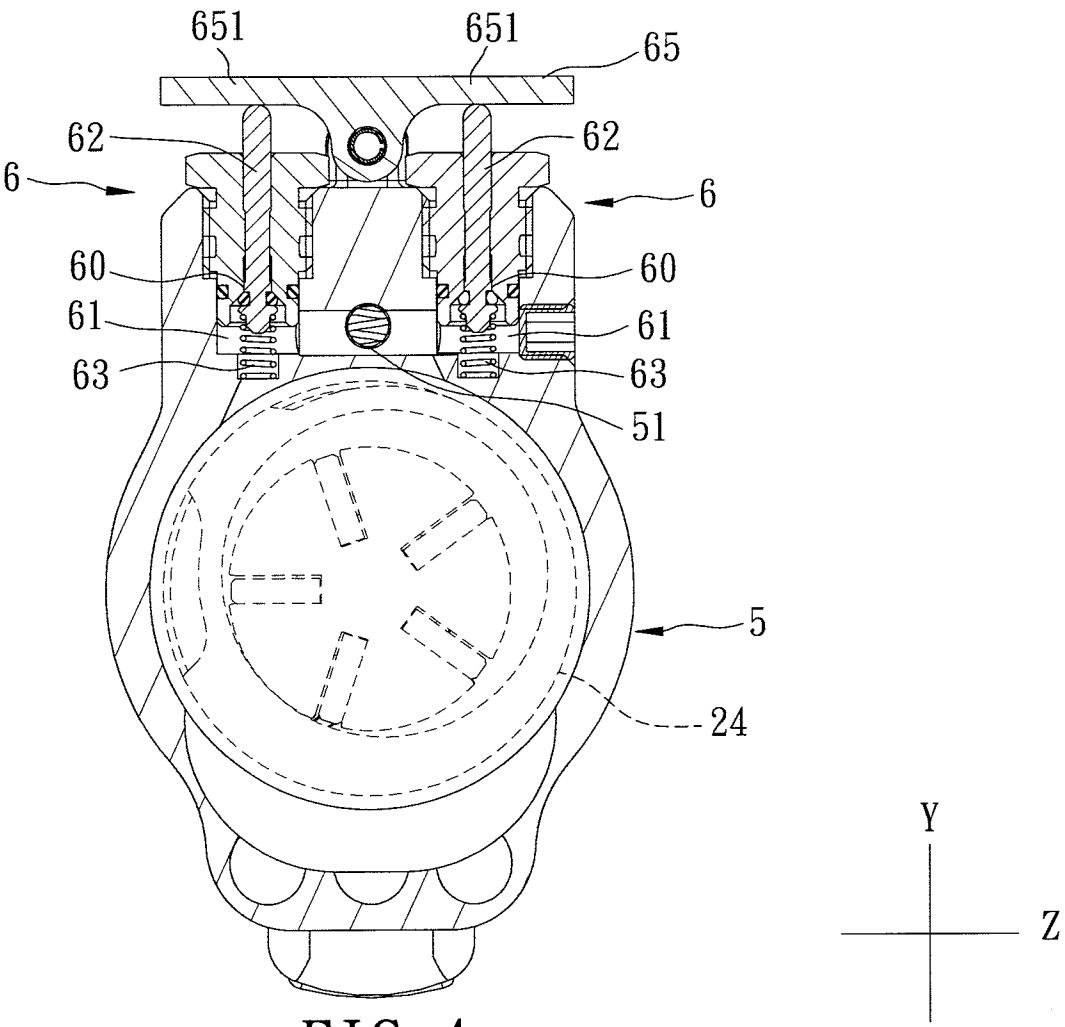
FIG. 4 is a cross-sectional view taken along line IV-IV of FIG. 3.

Referring to FIGS. 2 to 4, the left branch conduit 52 is disposed downstream of the main conduit 51 and upstream of the inlet port 311 of the left cylinder 31. The right branch conduit 52 is disposed downstream of the main conduit 51 and upstream of the inlet port 311 of the right cylinder 31. The left and right valve units 6 are disposed to control passage of the pressurized air in the left and right branch conduits 52, respectively. In this embodiment, the elongated shell 5 has two bores 61, each of which extends in the first transverse direction (Y) to intercommunicate the main conduit 51 and the respective branch conduit 52. Each of the left and right valve units 6 includes a valve seat 60 which is disposed in the respective bore 61, a valve rod-and-disc member 62 which is movable in the first transverse direction (Y) relative to the valve seat 60, and a third biasing member 63 which is disposed to bias the valve rod-and-disc member 62 to close the valve seat 60. A seesaw-like lever 65 is pivotably mounted on the elongated shell 5 about a fulcrum axis that is oriented in the longitudinal direction (X), and has two triggering ends 651 which are opposite to each other in the second transverse direction (Z), and which are in pressing engagement with the valve rod-and-disc members 62, respectively, so as to permit either one of the valve rod-and-disc members 62 to be moved away from and open the valve seat 60 against the biasing action of the third biasing member 63, as shown in FIG. 7.

When the main valve unit 7 is not subjected to an external force, the main valve rod-and-disc 72 is in an opening position such that the pressurized air enters and flows into the main conduit 51. As shown in FIGS. 4 and 5, at this stage, when no external force is applied to the lever 65, the valve rod-and-disc members 62 are in a closing position to cut off the pressurized air from flowing into the left and right branch conduits 52 such that the plungers 32 are kept in the non-pressurized position to have the actuators 41 disengaging from the direction selector 24. In this state, the drive body 22 is not driven by the swinging movement of the swingable ratchet member 21.

Figure 6:
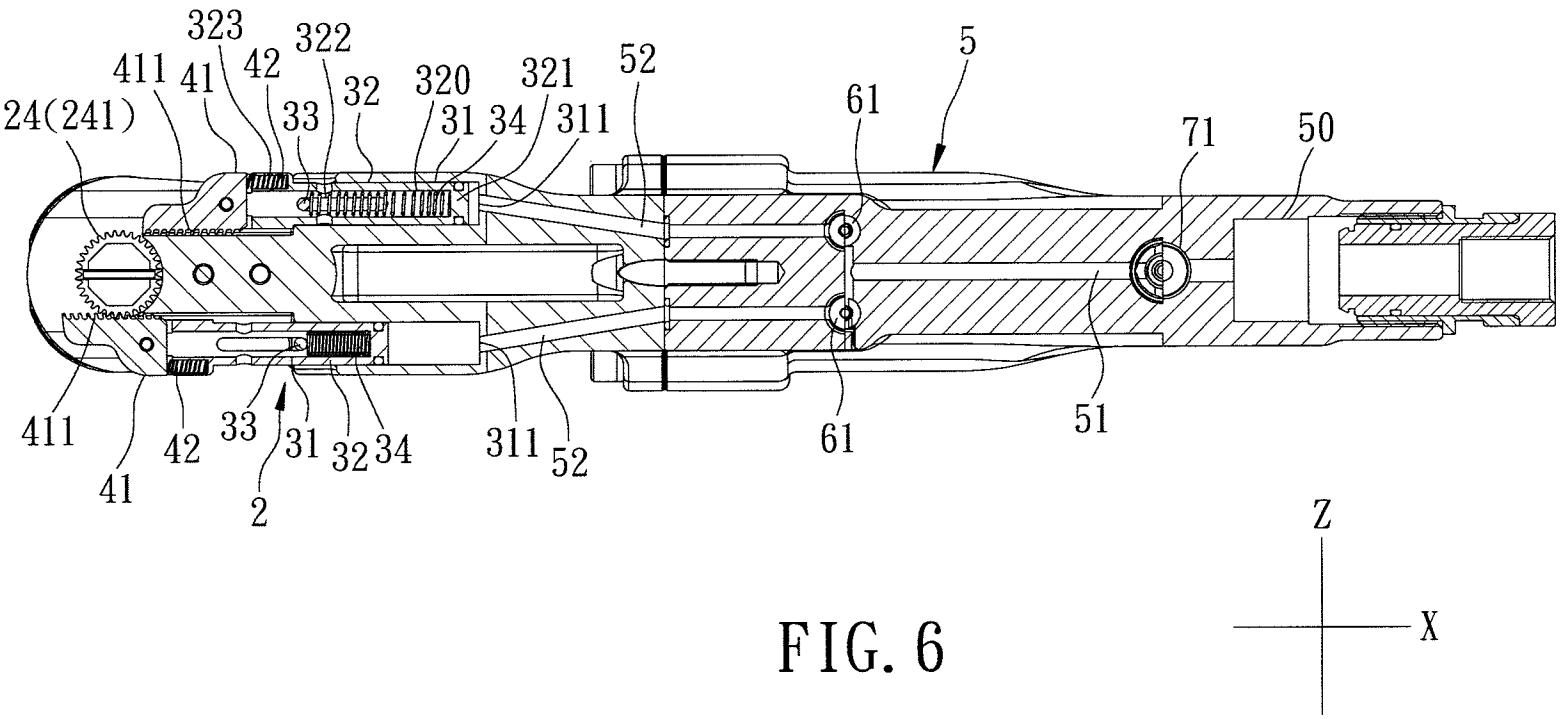
FIG. 6 is a sectional view similar to FIG. 3, showing a plunger in a pressurized position.
Figure 7:
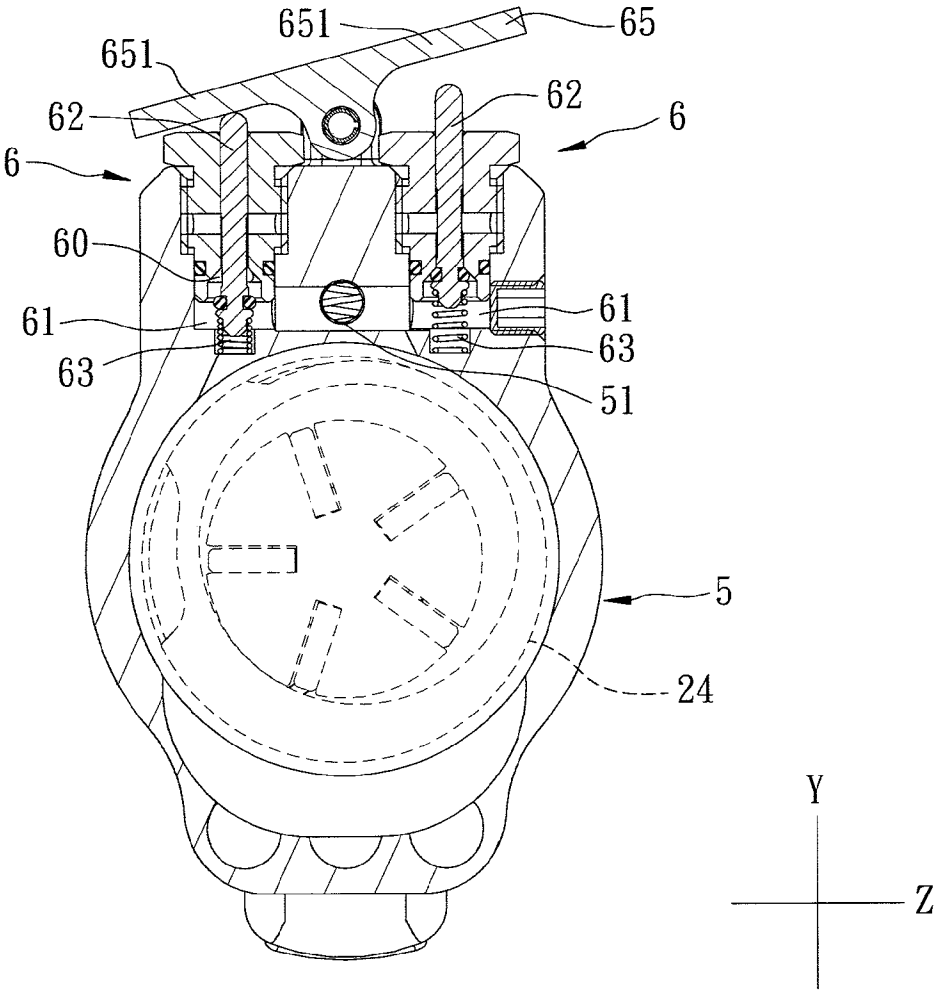
FIG. 7 is a cross-sectional view similar to FIG. 4, showing a valve unit in an opening position.

Referring to FIGS. 5 to 7, when a selected one of the triggering ends 651 is pressed to select one of the clockwise and counterclockwise directions of the direction selector 24, the corresponding valve rod-and-disc member 62 is moved to open the valve seat 60. A burst of the pressurized air is permitted to pass through the inlet port 311 of the corresponding cylinder 31 so as to move the corresponding plunger 32 and the actuator 41 forward to the pressurized position, where the rack region 411 of the corresponding actuator 41 is engaged with the toothed rim segment 241 of the direction selector 24. Thus, a selected one of the clockwise and counterclockwise forces is transmitted to unidirectionally rotate the drive-side segment 221 of the drive body 22.

When the pressing force on the selected triggering end 651 is released, the valve rod-and-disc member 62 is moved back to close the valve seat 60 to cut off the pressurized air, and the plunger 32 is moved back to the non-pressurized position by the biasing action of the first biasing member 34 such that the actuator 41 is moved to disengage from the direction selector 24. The pressurized air remaining in the branch conduit 52 and the cylinder 31 is discharged from the corresponding bore 61.

Figure 9:
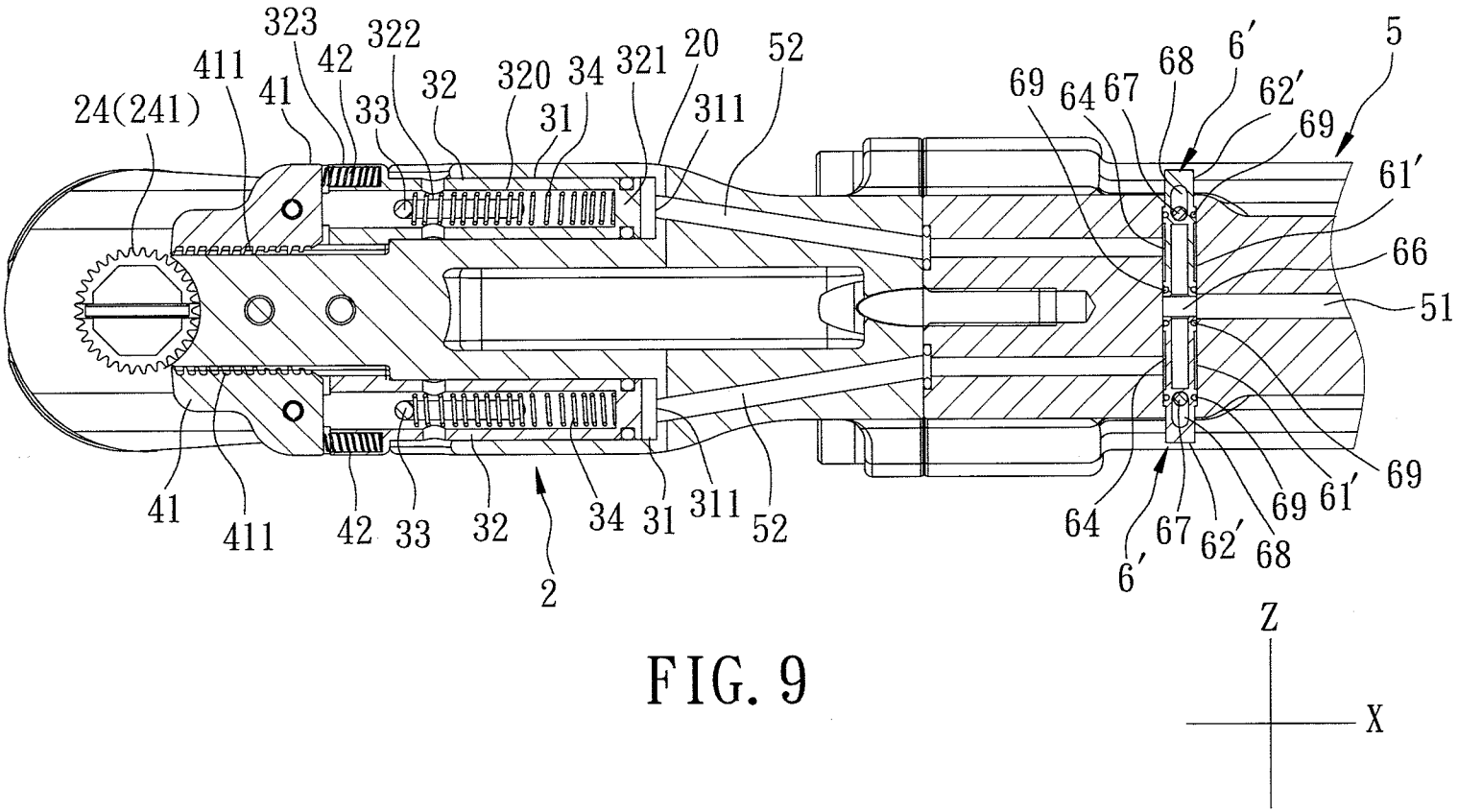
FIG. 9 is a fragmentary sectional view of the second embodiment of a pneumatic ratchet wrench according to this invention.
Figure 10:
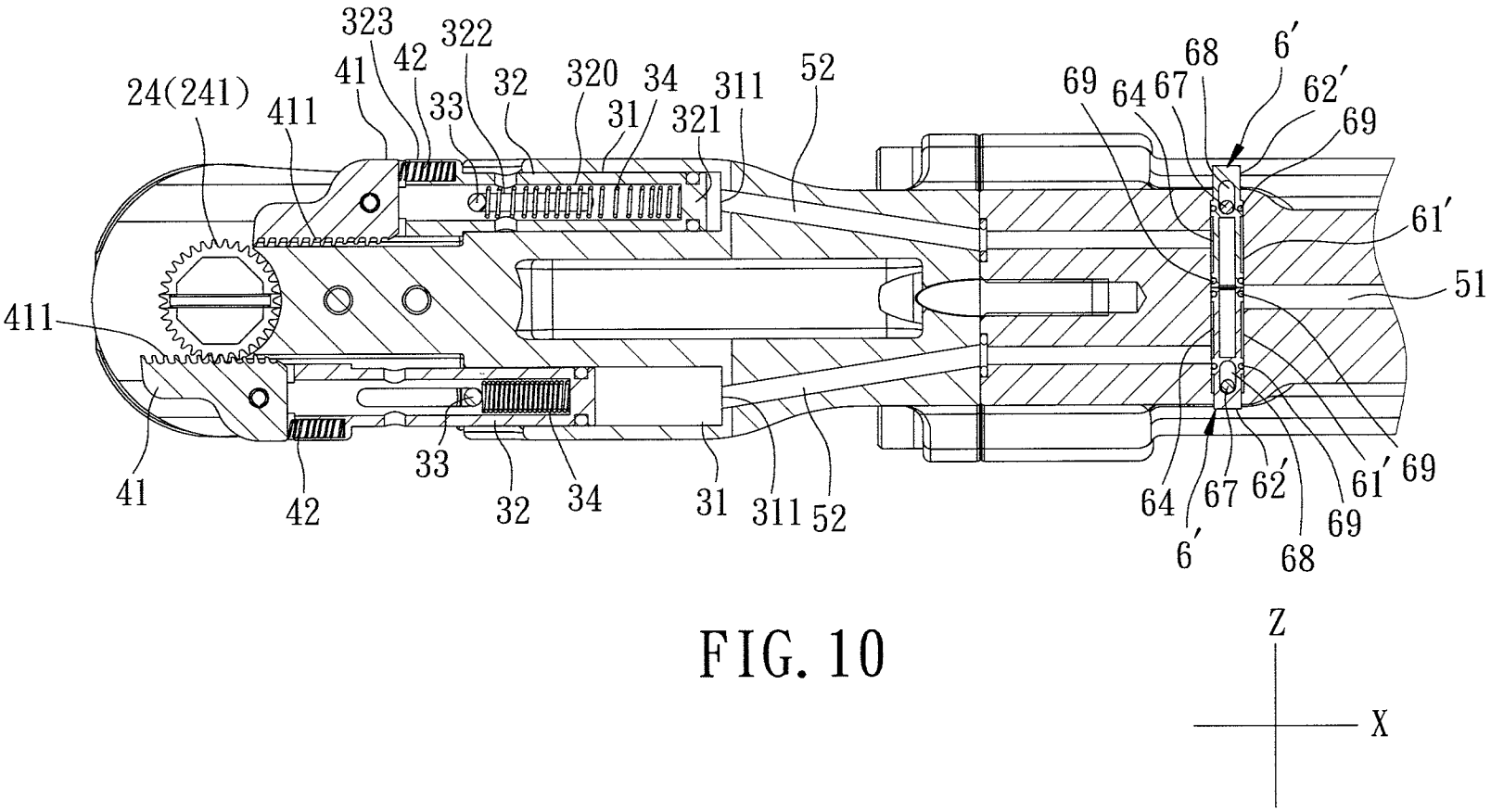
FIG. 10 is a fragmentary sectional view showing a plunger in a pressurized position.

Referring to FIGS. 9 and 10, the second embodiment of the pneumatic ratchet wrench according to this invention is shown to be similar to the first embodiment in construction. In the second embodiment, the elongated shell 5 has two bores 61', each of which extends in the second transverse direction (Z) to intercommunicate the main conduit 51 and a respective one of the left and right branch conduits 52 at a compressible zone 66 of the pressurized air. Each of the left and right valve units 6' includes a valve plunger 62' which is disposed in and movable along the respective bore 61' between a closing position, as shown in FIG. 9, where the compressible zone is uncompressed, and where the passage of the pressurized air into the left and right branch conduits 52 is cut off, and an opening position, as shown in FIG. 10, where the compressible zone 66 is compressed, and where the valve plunger 62' of a selected one of the left and right valve units 6' is closer to the other valve plunger 62'. Each of the valve plungers 62' extends outwardly of the respective bore 61' to form a button-like end for pressing by an operator. Additionally, each of the left and right valve units 6' includes a key-and-keyway assembly 67, 68 which is disposed between the valve plunger 62' and the elongated shell 5 to limit the movement of the valve plunger 62' between the closing and opening positions. Specifically, two O-rings 69 are disposed on two ends of each valve plunger 62' to form a slidable airtight seal for a surrounding clearance 64.

When the pressurized air enters the compressible zone 66 from the main conduit 51, the valve plungers 62' are forced by the pressurized air away from each other such that the communication between the bores 61' and the branch conduits 52 is interrupted, thereby keeping the plungers 32 in the non-pressurized position and the actuators 41 disengaging from the direction selector 24.

When a selected one of the valve plungers 62' is pressed to compress the compressible zone 66, the communication is established through the surrounding clearance 64 such that a burst of the pressurized air passes through the selected branch conduit 52 to press the corresponding plunger 32 to the pressurized position, thereby bringing the actuator 41 into engagement with the direction selector 24. Once the operator releases the valve plunger 62', the pressurized air flowing from the main conduit 51 forces the valve plunger 62' to move away from the other valve plunger 62' so as to interrupt the communication between the bore 61' and the branch conduit 52. Meanwhile, the plunger 32 is moved back to the non-pressurized position by the biasing action of the first biasing member 34 such that the actuator 41 is moved away to thereby disengage from the direction selector 24.

As illustrated, by pressing a selected one of the triggering ends 651 of the lever 65 or the button-like ends of the valve plungers 62', the operator can easily perform the direction selection with the hand gripping on the elongated shell 5. Moreover, by means of the arrangement of the conduits 52, the cylinders 31, and the plungers 32 serving as a pneumatically actuated reversing device, when one actuator 41 is brought into engagement with the direction selector 24, the other actuator 41 will not come into contact with the direction selector 24, thereby preventing malfunctioning of drive engagement of the rack regions 411 with the toothed rim segment 241. Besides, a smooth and firm engagement between the rack region 411 and the toothed rim segment 241 can be always ensured by means of the pressurized air instead of a manual force that is utilized in the known art.

Moreover, since the selected actuator 41 is engaged with the direction selector 24, rather than the pawl 23, and is moved along the linear path that is tangential to the toothed rim segment 241, the actuators 41 can be moved more quickly. Furthermore, since only the selected actuator 41 is engaged with the direction selector 24, and is disengaged therefrom immediately after turning of the direction selector 24 in a selected one of the clockwise and counterclockwise directions, there will be no occasion that vibration generated as a result of rotation of the drive body 21 might be transmitted to the plungers 32 and the actuators 41. Thus, the service life of the ratchet wrench can be prolonged.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A pneumatic ratchet wrench comprising:

a ratchet head unit including a head mounting frame which extends in a longitudinal direction, and which has selector-side and drive-side walls opposite to each other in a first transverse direction that is transverse to the longitudinal direction, a swingable ratchet member which is mounted on said drive-side wall, and which is adapted to be driven by a pneumatic drive unit to make a swinging movement about a rotating axis that is oriented in the first transverse direction, a drive body which is coupled with said swingable ratchet member to be unidirectional rotatable therewith, and which has a drive-side segment that extends in the first transverse direction for tightening or loosening a fastener, a pawl which has two pawl regions configured such that, in response to a selected one of clockwise and counterclockwise forces, a corresponding one of said first and second pawl regions is brought into pawl engagement with said swingable ratchet member so as to permit said drive body to be unidirectionally rotated with the swinging movement of said swingable ratchet member, a direction selector which is rotatably mounted on said selector-side wall, and which has a toothed rim segment and an actuating segment that is disposed to exert the selected one of the clockwise and counterclockwise forces on said pawl when said toothed rim segment is turned in a selected one of clockwise and counterclockwise directions, left and right cylinders which are disposed on said selector-side wall and spaced apart from each other in a second transverse direction that is transverse to the first transverse direction and the longitudinal direction, each of said left and right cylinders having an inlet port, left and right plungers, each fitted in and slidable relative to a respective one of said left and right cylinders to move between a non-pressurized position, where pressurized air is cut off from said inlet port, and a pressurized position, where a burst of the pressurized air is permitted to pass through said inlet port, and left and right actuators which are respectively disposed forwardly of said left and right cylinders, and which are respectively connected to said left and right plungers, each of said left and right actuators having a rack region which is moved along a linear path that is tangential to a respective one of two diametrically opposed areas of said toothed rim segment when a respective one of said left and right plungers is moved from the non-pressurized position to the pressurized position;

an elongated shell which is coupled with and disposed rearward from said head mounting frame, and which has a main inlet port adapted to be in fluid communication with a source of pressurized air, and a main conduit disposed downstream of said main inlet port;

a left branch conduit disposed downstream of said main conduit and upstream of said inlet port of said left cylinder;

a right branch conduit disposed downstream of said main conduit and upstream of said inlet port of said right cylinder; and left and right valve units disposed to control passage of the pressurized air in said left and right branch conduits, respectively.

2. The pneumatic ratchet wrench as claimed in claim 1, wherein each of said left and right plungers has a tubular chamber which terminates at a rear closed end, and a slot which extends in the longitudinal direction to terminate at front and rear limits, and which communicates with said tubular chamber, said head mounting frame having two pin posts, each of which extends radially into said tubular chamber and is fitted in said slot so as to abut against said rear limit, thereby preventing the respective one of said left and right plungers from moving beyond the pressurized position, and two first biasing members, each of which is disposed in said tubular chamber and between a respective one of said pin posts and said rear closed end so as to bias the respective one of said left and right plungers toward the non-pressurized position.

3. The pneumatic ratchet wrench as claimed in claim 1, wherein said left and right actuators are respectively and pivotally connected to said left and right plungers about a pivot axis that is parallel to the rotating axis so as to permit said rack region to turn away from said toothed rim segment when a respective one of said left and right plungers is moved toward the non-pressurized position, said ratchet head unit including two second biasing members, each of which is disposed between the respective one of said left and right plungers and an opposite region of the respective one of said left and right actuators relative to said rack region in terms of the pivot axis so as to bias said rack region toward said toothed rim segment.

4. The pneumatic ratchet wrench as claimed in claim 1, wherein said elongated shell has two bores, each of which extends in the first transverse direction to intercommunicate said main conduit and a respective one of said left and right branch conduits, each of said left and right valve units including a valve seat which is disposed in a respective one of said bores, a valve rod-and-disc member which is movable in the first transverse direction relative to said valve seat, and a third biasing member which is disposed to bias said valve rod-and-disc member toward said valve seat.

5. The pneumatic ratchet wrench as claimed in claim 4, further comprising a seesaw-like lever pivotably mounted on said elongated shell about a fulcrum axis that is oriented in the longitudinal direction, and having two triggering ends which are opposite to each other in the second transverse direction, and which are in pressing engagement with said valve rod-and-disc members, respectively, so as to permit either one of said valve rod-and-disc members to be moved away from said valve seat against biasing action of said third biasing member.

6. The pneumatic ratchet wrench as claimed in claim 1, further comprising a main valve unit including a main valve seat which is disposed in said elongated shell and which extends in the first transverse direction to communicate with said main conduit, and a main valve rod-and-disc which is movable in the first transverse direction relative to said main valve seat to control passage of the pressurized air.

7. The pneumatic ratchet wrench as claimed in claim 1, wherein said elongated shell has two bores, each of which extends in the second transverse direction to intercommunicate said main conduit and a respective one of said left and right branch conduits at a compressible zone of the pressurized air, each of said left and right valve units including a valve plunger which is disposed in and movable along a respective one of said bores between a closing position, where said compressible zone is uncompressed, and where the passage of the pressurized air into said left and right branch conduits is cut off, and an opening position, where said compressible zone is compressed, and where said valve plunger of a selected one of said left and right valve units is closer to said valve plunger of a non-selected one of said left and right valve units.

8. The pneumatic ratchet wrench as claimed in claim 7, wherein said valve plunger extends outwardly of a respective one of said bores to forma button-like end for pressing.

9. The pneumatic ratchet wrench as claimed in claim 7, wherein each of said left and right valve units includes a key-and-keyway assembly which is disposed between said valve plunger and said elongated shell to limit the movement of said valve plunger between the closing and opening positions.

* * * * *